United States Patent [19]

Bender et al.

[11] 4,252,638

[45] Feb. 24, 1981

[54] METHOD FOR THE DESULFURIZATION OF COAL

[75] Inventors: Hans Bender, Leverkusen; Werner Hasse, Bochum; Roland Pfeiffer; Karl-Heinz Unkelbach, both of Cologne, all of Fed. Rep. of Germany

[73] Assignee: Klockner-Humboldt-Deutz AG, Fed. Rep. of Germany

[21] Appl. No.: 967,096

[22] Filed: Dec. 6, 1978

[30] Foreign Application Priority Data

Dec. 7, 1977 [DE] Fed. Rep. of Germany ..... 2754468

[51] Int. Cl.[2] ..... B03B 1/00

[52] U.S. Cl. ..... 209/3; 209/8; 209/40; 209/214; 44/1 SR; 241/24

[58] Field of Search ..... 209/8, 9, 3, 11, 213, 209/214, 40; 44/1 R, 1 SR; 241/24

[56] References Cited

U.S. PATENT DOCUMENTS

| | | | |
|---|---|---|---|
| 2,962,231 | 11/1960 | Weston | 241/24 X |
| 3,463,310 | 8/1969 | Ergun | 209/8 |
| 3,754,713 | 8/1973 | Kienast | 241/24 |
| 4,052,170 | 10/1977 | Yan | 44/1 SR X |
| 4,081,251 | 3/1978 | Colli | 44/1 SR X |
| 4,098,584 | 7/1978 | Kindig | 209/9 X |

FOREIGN PATENT DOCUMENTS

| | | | |
|---|---|---|---|
| 795727 | 5/1958 | United Kingdom | 209/3 |
| 485768 | 9/1975 | U.S.S.R. | 44/1 R |

OTHER PUBLICATIONS

Min. Eng. Mag., Demineralization of Coal, Kester, May 1965, 72–76.

*Primary Examiner*—Robert Halper

*Attorney, Agent, or Firm*—Hill, Van Santen, Steadman, Chiara & Simpson

[57] ABSTRACT

A method for reducing the sulfur content of coal which involves an integrated, continuous process including the steps of grinding the coal in a dry state, activating the ground coal to increase substantially the magnetic susceptibility of the pyrite contained therein, and separating the thus activated pyrite magnetically from the remainder of the coal.

2 Claims, 3 Drawing Figures

METHOD FOR THE DESULFURIZATION OF COAL

BACKGROUND OF THE INVENTION

1. Field of the Invention

This invention is in the field of reducing the sulfur content of coal in a continuous, integrated process involving grinding the coal, activating it thermally, chemically, or otherwise, to make the pyrite constituent more magnetically susceptible and then separating the activated pyrite magnetically from the remainder of the coal.

2. Description of the Prior Art

The desulfurization of coal has been a matter of concern for a long period. Research of the Bergbau-Forschung GmbH of North Rhine Westfalia has determined that about 60% of the total sulfur of the coal recovered in the Ruhr coal district is bound to iron and of this amount approximately 75% is present as free pyrite or pyrite loosely combined with coal and mine waste. Accordingly, on an average up to about 40% of the total sulfur of such coal is regarded as separable by proper procedures.

Research steps have further revealed that almost 80% of the separable pyrite is present in a grain size which is coarser than 0.06 mm. Because the density of the pyrite is at an average of about 5, that of the mine waste is about 2.5, and that of the coal about 1.3 kg/dm$^3$, various separation procedures involving a comminution of the coal and gravity sorting methods have been used to effect such separation. For example, with a grain size range of 0 to 10 mm, it was possible to separate on the fine grain settling machines barely 40% of the pyrite sulfur in the tailings. The sulfur content of the raw coal could thereby be reduced by about 10%.

With finer grain fractions, the most favorable results were obtained with flotation, whereby a reduction of pyrite sulfur up to 65% was attained, corresponding to a lowering of the total sulfur content by about 50%. Flotation processes, however, are usable only with grain sizes less than 1 mm.

For grain sizes in the range of 0.06 mm to 3 mm, suitable results can be obtained through the use of oscillating tables where in the most favorable case, there can be obtained a removal of pyrite of about 60% and a total sulfur removal corresponding to approximately 40%.

In the case of very fine grain materials, separation by means of a water cyclone has also been successful, whereby in some cases a total sulfur removal of approximately 50% could be obtained.

In any of these cases, however, there was a disadvantage that there was a relatively high loss in convertible coal in the removal of the sulfur-rich concentrate.

Any wet separation method is not desirable where the coal is to be used, for example, in the operation of power plants where the coal is blown as a dust directly into the combustion chamber in dry condition. Because of this, it was also attempted to carry out the treatment of the coal in a dry manner, for example, through sorting in a magnetic field. The basis for this separation is the fact that pure pyrite (Fe $S_2$) which is either diamagnetic or weakly paramagnetic may be converted into ferromagnetic or at least more strongly paramagnetic through activation to increase its magnetic susceptibility by a factor of 10 to 20. This can occur, for example, by means of reduction of the pyrite to pyrrhotin ($Fe_7S_8$) or also through the oxidation of the pyrite to $Fe_2O_3$ or $Fe_3O_4$.

A known method of this type is called the thermal activation of pyrite and uses treatment temperatures in the range of 300° to 500° C., and preferably at 400° C. On heating a pyrite sample in an electric resistance furnace, the magnetic susceptibility remains approximately constant up to about 300° C. Beyond this, the susceptibility rises greatly so that at a temperature of about 380° C., the susceptibility is increased by a factor of about 20. The sulfur-iron combination so treated is well adapted to sorting according to differences in magnetic susceptibility.

A disadvantage of this process, however, is the difficulty which results because the coal may contain substantial amounts of readily volatile constituents which may be lost or may present a disposal problem when the coal is heated to temperatures of about 400° C. Furthermore, the cost of operation and capital expenses are substantial for this type of process.

SUMMARY OF THE INVENTION

The present invention provides a dry process for treating power plant coal for desulfurization utilizing magnetic separation as well as activation of the pyrite portion through thermal, mechanical or chemical means more economically than was possible with previously known and investigated methods. Specifically, the present invention provides a method consisting of a combination of integrated process steps consisting of dry grinding of the coal, activation of the pyrite sulfur, and magnetic separation of the activated pyrite.

BRIEF DESCRIPTION OF THE DRAWINGS

Examples of the method according to the present invention are illustrated in the drawings in which.

DESCRIPTION OF THE PREFERRED EMBODIMENTS

Figure 1:
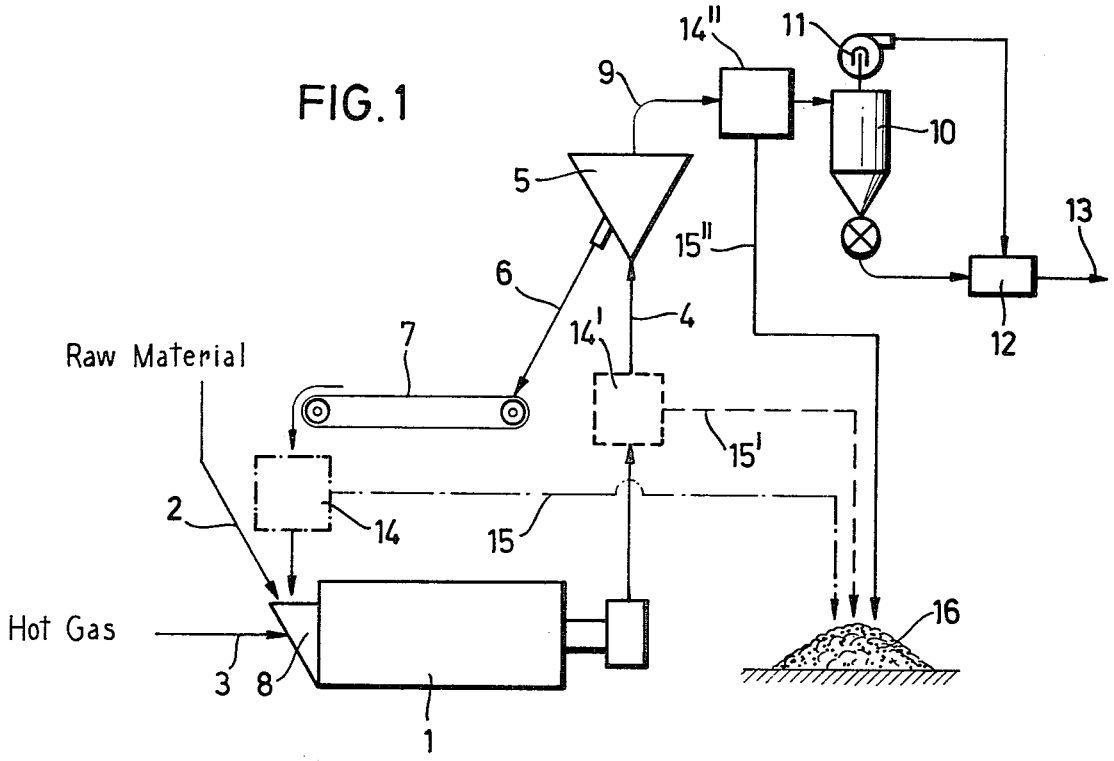
FIG. 1 is a schematic block circuit diagram of a grinding installation according to the present invention, with several alternative arrangements.

One of the surprising findings in accordance with the present invention was that through the impact and friction effects of the grinding operation, microscopic local temperature increases are produced with high temperature gradients, with low quantities of heat per point of impact. At a plurality of microscopically small impact and striking points, conditions are achieved which lead to the activation of a small quantity of pyrite. In this manner, there result from the myriad microscopic, thermal conversion points in the grinding process, usable quantities of activated iron-sulfur complexes. There is the further advantage that during the grinding, the fine iron fines of the grinding body combine, in effect, with the already present sulfur-iron complexes to form highly active sulfur-iron complexes, thereby enhancing the activation process of the pyrite sulfur. According to the observations of Ergun and Bean (IEEE Transactions on Magnetics, Volume 12, No. 5, September 1976, Page 538 et seq.), in ferromagnetic combinations, a significant accentuation of the susceptibility coefficients in adherent pyrites can be observed. Accordingly, it may be that through the grinding procedure, a complex mechanical-chemical-thermal activation of a portion of the pyrite sulfur is converted to a condition of higher susceptibility which makes it possible in an economical manner to combine the grinding with the activation of the pyrite sulfur and the magnetic separation of the activated pyrites in an integrated, continuous process. Accordingly, the process of the present invention is preferably carried out in a closed system in the grinding installation, preferably under the atmosphere of a protective gas so that the activation of the sulfur carrier takes place at least in part during the grinding process.

In another preferred embodiment of the present invention, an additional activation and/or magnetic separation is undertaken within the closed system of the grinding installation between the magnetic separator and the burner which receives the coal dust.

In one embodiment of the present invention, the coal is heated outside of the grinding mill but within the closed system of the grinding installation for optimizing the activation at temperatures between 200° C. and 500° C. and preferably at about 300° C. The heating is carried out for a duration of 1 to approximately 100 minutes, and preferably at 1 to 10 minutes, and the coal is held at the selected temperature for that period of time.

When the coal is heated in the closed system of the injection mill, volatile constituents escaping from the coal upon heating are not lost but arrive with the partially degasified remainder of the coal as a combustible mixture at the burner.

In accordance with the present invention, the coal before magnetic separation may be subjected to a chemical treatment of the type known in the art for increasing the magnetic susceptibility of the sulfur carrier. For example, the coal may be treated with oxidizing agents such as nitric acid, sulfuric acid, hydrogen peroxide, potassium permanganate, and the like.

In a further embodiment of the invention, the coarse particles resulting from the classification of the mill discharge may be subjected to an activation and/or magnetic separation before return of the particles into the grinding process. In a particularly preferred form of the invention, the relatively coarse material, the so-called gravel, before activation and/or magnetic separation, may be subjected to a dry sorting according to density, and the heavy material subjected to activation and/or magnetic separation, while the light material is supplied without intermediate treatment to the grinding process.

Turning now to the drawings, in FIG. 1 there is shown a grinding mill 1 being supplied with raw material through an inlet line 2. Hot gas is delivered to the mill 1 through an inlet line 3. The mill 1 is connected at its discharge side by means of a conduit 4 with a classifier 5 which may be in the form of an air current classifier. From the classifier 5, a conduit 6 directs the discharge through a transporting device or conveyor 7 to the inlet 8 of the grinding mill. The coarse portion of the discharge separated out by the separator 5, the so-called gravel, is conveyed back in this manner to the grinding process.

The separator 5 has a conduit 9 for the discharge of finished material which is separated by means of an additional separator 10 into coal dust and gas. Through the aid of a ventilator 11 as well as a mixing device 12, the coal dust and carrier gas, as indicated by the arrow 13, are blown into a combustion chamber (not shown).

In this closed circulatory system, there are many different alternative possibilities for the arrangement of the magnetic separators. For example, they may be included in the path of material going from the conduit 6 and the conveyor 7, as illustrated by the chain line box 14. From the magnetic separator, the pyrite sulfur is discharged along a conveying means 15 onto a refuse heap 16.

Alternatively, a magnetic separator as shown by dashed line box 14' may be in the conduit line 4 extending between the discharge of the mill 1 and the separator 5. In this case, the return path for the pyrite separated out has been identified at reference numeral 15'.

A further alternative is shown in the arrangement of a magnetic separator 14" located in the conduit 9 between separator 5 and separator 10. The corresponding conduit for the return of the separated pyrite portion is identified at reference numeral 15".

Figure 2:
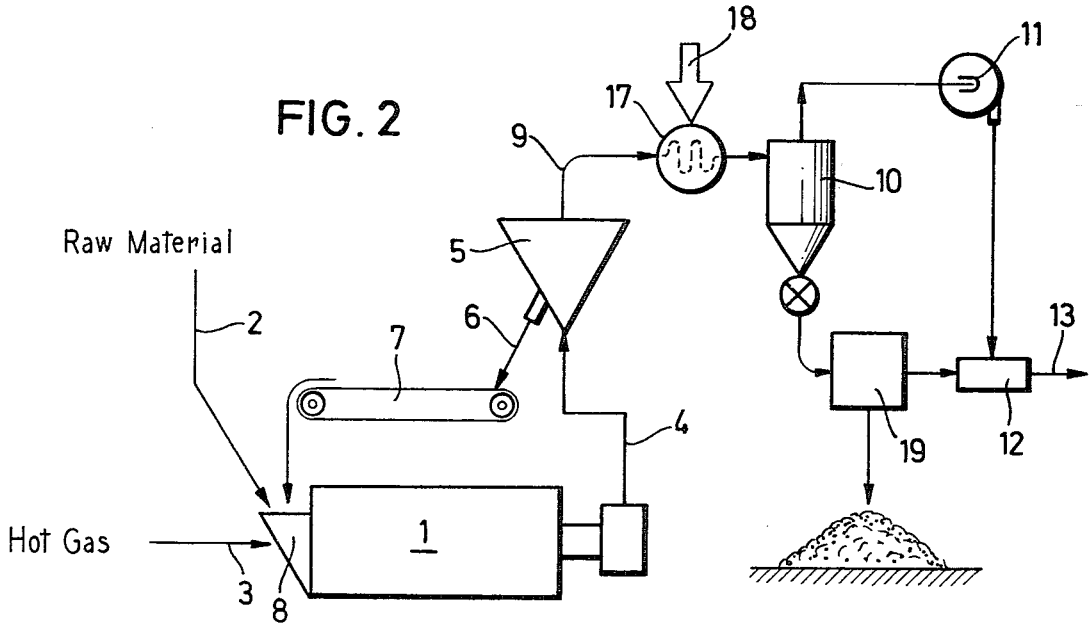
FIG. 2 illustrates a modified form of the present invention also in block circuit diagram form.

FIG. 2 shows a similar arrangement in which, however, the finished product consisting of coal dust is passed to a reactor 17 where heat is introduced as indicated by the arrow 18. The heat serves to cause additional thermal activation of the pyrite portion. The finished material is heated, for example, to about 400° C. After separating out the coal dust in the separator 10, the magnetic sorting of the material preactivated in the mill and subsequently thermally activated to completion at reactor 17 takes place by means of a magnetic separator 19 all as part of a closed system. The separator 19 is located directly in front of a mixing device 12 for mixing the coal dust with a carrier gas. Reference numerals of FIG. 2, where appropriate, designate the same elements as in FIG. 1.

Figure 3:
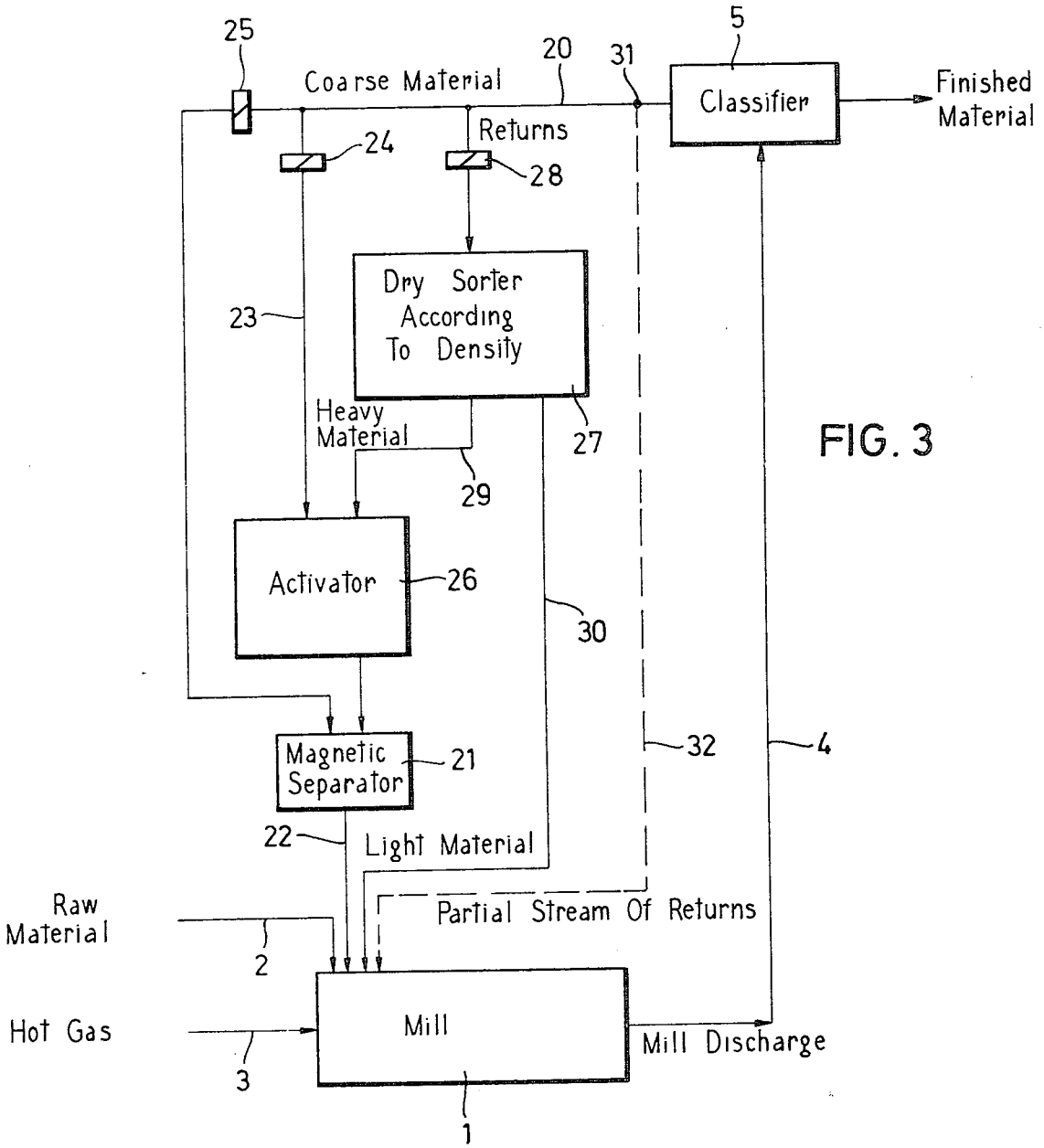
FIG. 3 illustrates further embodiments which can be used in the block circuit diagram.

FIG. 3 illustrates further alternatives of the invention. From the classifier 5, a return conduit 20 directs back coarse material to a magnetic separator 21 and from there by means of a conduit 22 to the charging side of the mill 1. Alternatively, within a branch conduit 23, after closing a closure member 24 and a closure member 25, the returns may be charged back through the activating device 26. In the device 26, a desired activation process is carried out which is preferably a chemical or a thermal activation process which additionally optimizes the activation process for the activation of coal during the grinding process. From the activation device 26, the activated material arrives at the magnetic separator and from there into the inlet of the mill 1.

A further alternative results through the addition of a dry sorting device operable upon differences in density, for example, with the aid of an air or pneumatic separating table 27. The coarse material from the separator 5 is first guided through a closure member 28 and then into the pneumatic table 27 which sorts the material according to density.

The heavy material separated out by the pneumatic table 27 arrives by means of transporting device 29 and the activator 26 and subsequently the magnetic separator 21. After removal of the pyrite portion, the heavy material goes back to the mill 1 while the light material is charged into the transporting device 30 directly from the pneumatic table into the mill.

It is also possible to branch off a partial stream of return material at a point 31 and direct this stream by means of a conduit 32 directly into the inlet of the mill 1.

It should be evident that various modifications can be made to the described embodiments without departing from the scope of the present invention.

We claim as our invention:

1. A method for reducing the sulfur content of coal which consists essentially of the steps of:

(a) grinding the coal in a dry state, (b) activating the ground coal during such grinding to increase substantially the magnetic susceptibility of a portion of the pyrite contained therein by inducing local microscopic high temperature gradients in said portion of the pyrite by the impact and friction effects of said grinding, (c) separating the ground coal into coarse and fine particles, (d) separating the thus activated pyrite portion magnetically from the fine and coarse coal particles, (e) collecting the fine coal particles and returning the coarse coal particles for mixture with the coal in step (a), and (f) continuously repeating steps (a) through (e), 2. A method according to claim 1 in which:

said method is carried out in a closed system under an atmosphere of protective gas.

* * * * *